US010880659B2

(12) United States Patent
Pedersen et al.

(10) Patent No.: US 10,880,659 B2
(45) **Date of Patent: *Dec. 29, 2020**

(54) PROVIDING AND TRANSMITTING AUDIO SIGNAL

(71) Applicant: Oticon A/S, Smørum (DK)

(72) Inventors: Michael Syskind Pedersen, Smørum (DK); Povl Koch, Smørum (DK); David Thorn Blix, Smørum (DK); Matias Tofteby Bach, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/845,445

(22) Filed: Apr. 10, 2020

(65) Prior Publication Data

US 2020/0245082 A1 Jul. 30, 2020

Related U.S. Application Data

(63) Continuation of application No. 16/131,613, filed on Sep. 14, 2018, now Pat. No. 10,659,893.

(30) Foreign Application Priority Data

Sep. 15, 2017 (EP) ..... 17191380

(51) Int. Cl.
*H04R 25/00* (2006.01)

(52) U.S. Cl.
CPC ..... *H04R 25/554* (2013.01); *H04R 25/43* (2013.01); *H04R 25/505* (2013.01); *H04R 2225/55* (2013.01)

(58) Field of Classification Search
CPC .. H04R 2225/55; H04R 25/43; H04R 25/505; H04R 25/554
(Continued)

(56) References Cited

U.S. PATENT DOCUMENTS 8,838,262 B2 * 9/2014 Mehta ..... H04N 21/233 348/515
2009/0076804 A1 3/2009 Bradford et al.
(Continued)

FOREIGN PATENT DOCUMENTS

WO WO 00/78093 A1 12/2000

*Primary Examiner* — Vivian C Chin
*Assistant Examiner* — Friedrich Fahnert
(74) *Attorney, Agent, or Firm* — Birch, Stewart, Kolasch & Birch, LLP

(57) ABSTRACT

There is provided a system (100) comprising an audio streaming device (102) having an audio streaming device receiver (104) arranged for receiving a first audio signal (106) comprising a first audio content and a second audio signal (108) comprising a second audio content, the system furthermore comprising a memory device (110) arranged for storing a user defined setting (112), a processor (114) arranged for providing an output audio signal (116), said output audio signal comprising a combination of the first audio content, and the second audio content, wherein the output audio signal comprises a ratio of a level of the first audio content and a level of the second audio content, and the ratio is determined based on the user defined setting (112), and wherein the system is further comprising a system transmitter (118) arranged for wirelessly transmitting the output audio signal (116).

19 Claims, 4 Drawing Sheets

(58) Field of Classification Search
USPC ..... 381/25.1, 109; 707/748, 770; 711/103, 711/E12.001, E12.008; 455/41.2, 411; 700/94, 276
See application file for complete search history.

(56) References Cited

U.S. PATENT DOCUMENTS

| | | | | |
|---|---|---|---|---|
| 2009/0245539 | A1 | 10/2009 | Vaudrey et al. | |
| 2010/0293319 | A1 | 11/2010 | Lim et al. | |
| 2011/0144783 | A1* | 6/2011 | Reichelt | H04S 7/30 700/94 |
| 2011/0188662 | A1 | 8/2011 | Jensen et al. | |
| 2011/0216928 | A1 | 9/2011 | Eisenberg et al. | |
| 2013/0198630 | A1 | 8/2013 | Lake, Jr. et al. | |
| 2014/0067828 | A1 | 3/2014 | Archibong et al. | |
| 2015/0139459 | A1 | 5/2015 | Olsen et al. | |
| 2016/0292943 | A1 | 10/2016 | Ranchod | |
| 2017/0235544 | A1* | 8/2017 | Nyegaard | H04H 60/04 700/94 |
| 2018/0124438 | A1 | 5/2018 | Barnett | |
| 2018/0205993 | A1 | 7/2018 | Richman | |

* cited by examiner

PROVIDING AND TRANSMITTING AUDIO SIGNAL

CROSS-REFERENCE TO RELATED APPLICATIONS

This application is a Continuation of co-pending application Ser. No. 16/131,613, filed on Sep. 14, 2018, which claims priority under 35 U.S.C. § 119(a) to Application No. 17191380.9, filed in Europe on Sep. 15, 2017, all of which are hereby expressly incorporated by reference into the present application.

FIELD

The present disclosure relates to providing and, optionally wirelessly or wired, transmitting an audio signal. More particularly, the disclosure relates to a system and method for combining audio signals into an output audio signal and transmitting the output audio signal. The transmission may be wireless or wired.

For many people speech, e.g., in television is difficult to understand due to background noise. For example, many television programs are pre-produced and the audio track is a mixture of many different sound sources, such as speech and background noise. Background noise could be, e.g., music or sounds related to the visual scene.

Therefore, there is a need to provide a solution that addresses at least some of the above-mentioned problems.

SUMMARY

According to an aspect, the present disclosure provides a system as outlined below. The system is to be connected to a source providing a television signal, this television signal could be received via antenna or cable or broadcast via the internet, or any other suitable means. Also, the signal may originate from a media player, such as a DVD/BluRay player or the like.

From the source a signal comprising both images and sound, together constituting video, is received. The present disclosure is focused on the sound part of the signal, and in the following it is assumed that mainly the sound is improved by the methods and systems as described herein. The images, i.e. the visual part of the source signal, may be used as part of the method and/or systems.

The sound signal from the source is preprocessed so that it is split into a first audio signal and a second audio signal, either in the system or a device connected thereto. The first audio signal and the second audio signal may be stereo signals or multichannel signals, such as surrounds sound signals, such as a so-called 5.1 surround sound signal or 7.1 surround sound signal.

The split of the sound signal into the first audio signal and the second audio signal is based on distinguishing between speech and noise, so that the first audio content is mainly speech and the second audio content is mainly background sounds without or at least with less speech. For some audio formats, e.g. Dolby 5.1, speech is already predominantly present in one channel, in 5.1 speech is mainly present in the center channel.

The ratio may be based on speech-to-noise. The ratio may be defined as a deviation with respect to mixing ratio of the original stream. The ratio may be dependent on voice activity. Other considerations regarding the ratio is provided in the present disclosure.

The system may comprise:

an audio streaming device having an audio streaming device receiver arranged for receiving a source signal comprising at least audio, and the audio streaming device further arranged for splitting the audio into at least a first audio signal and a second audio signal wherein:

a. the first audio signal comprising a first audio content, b. the second audio signal comprising a second audio content, A memory device arranged for storing a user defined setting, A processor arranged for providing an output audio signal, said output audio signal is based on a combination of:

a. The first audio content, and b. The second audio content, wherein the combination of the first audio content and the second audio content is based on a ratio of: a level of the first audio content and a level of the second audio content, and the ratio is determined based on the user defined setting, A system transmitter arranged for transmitting the output audio signal.

There may also be the case where the initial step of splitting the signal may be performed at the provider's end, meaning that the split is performed before the signal is transmitted to an end user. Further, there is a possibility that the provider may apply compensation for the user's specific hearing loss before transmitting the signal to the user, thereby the provider will perform the application of the ratio mixing and the signal sent from the provider is the output audio signal, along with possible video part.

The level is in the present context preferably sound level, such as measured on a relative scale or absolute scale.

The first audio content could be mainly, entirely, or substantially, voice, and the, at least one, second audio content could be mainly, entirely, or substantially, other audio content, such as non-voice sounds, such as background sounds.

Also, in one instance a specific audio signal could contain the desired audio stream. A second, or even more, audio signals could then contain some other content. The first audio content should, in this case, be enhanced by changing the ratio between the first and second audio signal.

In further instances, the first content actually present may be determined by a VAD—voice activity detector.

Still further, the first audio signal could contain one mixture of the first and second audio content. The second, or even more, audio signal contains another mixture of the first and second audio content. The audio channels may then be re-mixed in order to achieve a channel which mainly or entirely contains the first audio content while the second (or other) channels contains the other audio content. The ratio of the segregated signals may thus be adjusted to the desired level.

In further developments, it could be imagined that more than two contents, e.g. voice/speech, background music and background noise, are present. In this case, the ratio between all the different contents could be adjusted according to the users settings and/or hearing loss.

Currently it may be advantageous that the first audio content is different from the second audio signal content. One signal may be substantially voice and the other may be something different, however, the format may still be the same, i.e. stereo or the like, or one signal may be a sub-part of the other, e.g. a voice channel in a multichannel format.

Further, there may be more than two classifications of the audio content. The signal could be divided into more categories, such in three categories including voice, music, background.

The system transmitter may operate by transmitting the output audio signal to a hearing aid or a television or loudspeaker, either wirelessly or via a wired connection, either directly or via an intermediate device.

The system as disclosed in the present specification could be provided as a stand-alone product connected to a signal source, e.g. the output from a TV or directly to an antenna, satellite or terrestrial, or to a cable TV connection, or a device receiving a signal streamed over an internet connection, or as mentioned elsewhere a device such as a DVD or Blu-ray player. Further, the device could be integrated in a television so that the television itself could perform the processing and provide a signal to e.g. a hearing aid.

The user defined setting may be one of a number of settings, and in some cases, multiple settings are defined and stored in the memory, this means that when defining the ratio, more than one user defined setting may be taken into account. The user defined setting may depend on the hearing loss. E.g. if the users hearing loss causes difficulties when understanding speech in background noise, the ratio between the first audio content, containing speech, and the second audio content, containing background noise, should be improved. The improvement could be such that the ratio between speech and background noise is at least 10 dB. For milder hearing losses, where the listener do not have difficulties, or at least do not experience substantial difficulties, in noise, the ratio could be smaller or even unaltered compared to the original mixture of the first and second audio content. Alternatively, the user defined setting could be based on a questionnaire revealing the amount of difficulties the listener has when understanding speech in background noise or the setting could be based on a speech intelligibility test. In addition to adjusting the ratio depending on the hearing loss, the audio signal may be adjusted in other ways. E.g. by moving/transposing frequencies to audible areas with frequency lowering techniques applied to one or all audio contents. Such techniques could be vocoding, slowing down the playback, frequency transposition, frequency shifting or frequency compression.

The ratio could alternatively be calculated at the signal provider. E.g., the mixing ratio may already be adjusted according to a hearing loss before the signal is broadcasted via e.g. the internet.

The part of adjusting the level could, in an alternative, be performed in the hearing aid, even though it would entail transmitting the first and the second audio content separately.

The first audio content and/or the second audio content may be single channel or more than one channel audio, such as stereo channel sound, such as multichannel sound, such as in a 5.1 or 7.1 channel format.

The system, device and method according to the present disclosure may be used when receiving two stereo channels, alternatively multichannel signal is received and then converted into a stereo signal, which both contain speech and noise, i.e. speech and noise are present in both channels. In the present context, stereo is taken to mean two channels where each channel is intended to be presented to a user who will perceive it as a left ear signal and a right ear signal, respectively. The stereo signal may be presented to the user in a number of ways, including a binaural hearing aid system, a speaker set, a television, a headset, a set of headphones, one or more cochlear implants, one or more bone anchored hearing aids, other types of, least partly, implantable hearing aids. The stereo sound mixture may e.g. take into account whether the audio signal is presented through stereo loudspeakers or presented via headphones or hearing instruments directly into the ear canal or via cochlear implants or via bone conduction, or any other types of audio equipment or any combination. The present disclosure provides possibility to segregate the speech and noise into two new channels—which mainly comprises respectively speech and noise. Afterwards, the channels are remixed with a desired ratio. Unmixing parameters could either be calculated online or be provided as meta information along the audio (and video) stream.

In the method and system according to the present disclosure, the signal being outputted to the user may be a mono signal, i.e. output is only provided to one ear of the user, or, the same mono signal is presented at both ears of the user.

In an aspect, a broadcast signal comprising two parts is disclosed. The signal is a broadcast signal. The first part and the second part of the broadcast signal are separate channels for speech and noise. The broadcast signal may be transmitted via a medium to an end user. The medium may include the internet, a cable or airborne television transmission system, a carrier such as an optical disk. The broadcast signal may comprise metadata representing information on how the separation, and hereby, the Signal-to-Noise-Ratio adjustment may be realized. An example of meta-data could be unmixing parameters.

Each of the first and second audio signal may be analog or digital. The first audio content may be substantially, such as exclusively, voice, or at least have a low content of non-voice signal part. The second audio content may be substantially, such as exclusively, non-voice and/or background or at least have a low content of voice signal part. Alternatively, two mixtures each with different mixing levels could be segregated into a substantially voiced and a substantially unvoiced part. Blind source separation methods may be used for this purpose. The processor may be or at least include, a mixer or mixer function, such as being arranged or configured for combining (such as "mixing") at least two different audio signals wherein the level of one or both audio signals may be changed. In the combining or mixing the sound level in each of the two signals may be determined and a desired or appropriate ratio may be established, e.g. by applying gain and/or attenuation to either one or both of the signals. The ratio may be determined by more factors than the two signals, such as the sound ambient level around the user, e.g. measured using a microphone of an ear level device used by the user, such as a hearing aid, or alternatively by including a microphone in a stationary device configured for performing the sound processing. Another option could be to adjust the ratio depending on whether the TV is muted (or the current volume setting of the TV), as the TV is assumed to be the most significant sound source. The ratio may be fixed or fluctuating. The ratio may be determined for a period of time, e.g. a few milliseconds, a few seconds, minutes, hours or less or even for longer periods of time, in that way the ratio may fluctuate over time. The ratio may be relative to the input mixing ratio. The ratio may be determined based on events, e.g. events in the sound signal. Such an event could be onset of speech, end of speech, pauses in speech, the current or timed average signal-to-noise ratio in a specific channel or stream or signal, the ratio could be determined based on an estimate of the speech intelligibility.

Wireless transmission may be carried out using any one of a number of protocols and/or carriers, including, but not limited to, near-field magnetic induction (NFMI), baseband modulation, Bluetooth™, WiFi-based, radio frequency (RF) transmission, such as in the Giga Hz range, or any other type of suitable carrier frequency and/or using any other type of suitable protocol.

The separate first and second audio signal may be provided from a provider, e.g., a broadcasting company or may be generated at the user. For example, a broadcasting company may record and transmit separate signals comprising, respectively, speech and background. In another example, a combined signal is transmitted from a broadcasting company, and at the end user a unit of the system split the signal into first and second audio signals, e.g., via a voice recognition unit, or at least voice activity detection, which enables providing for example a first audio signal with speech and a second audio signal with background.

In one aspect, a signal could be broadcasted, wherein the signal comprises meta data information relating to speech and/or noise content in an audio part of the signal. Such meta-data could be subtitles. Other type of meta-data could be information from a program overview, this could allow for preset profiles for certain television transmission to be automatically selected or suggested to the user. This could ease the user's interaction by e.g. presenting a choice of 'talk show', 'action movie', 'news' to the user. Other presets are of course possible. The presence of subtitles can indicate presence of speech. Further, some providers provide a signal having multiple channels with speech, where each channel presents a specific language, e.g. a movie where it is possible for the system to analyze speech in multiple channels, e.g. at least in two channels, such as the main channel and an additional channel, to identify e.g. speech onset in the main channel. This could be the case where the source provides a video signal with two sound tracks allowing the user to choose between two languages. In that case, across-language-correlated parts of the signals indicate noise (assuming the background noise is not dubbed) while across-language-uncorrelated parts of the signals indicate speech.

By having the processor providing the output audio signal based on user defined setting, the user, such as the end user, is allowed to adjust the ratio between the level of the first audio content and the level of the second audio content according to the specific user's preferences and by having the first audio content and the second audio content combined in the output audio signal before transmission, such as transmission to a hearing aid, it may be achieved that fewer channels are needed for transmission (e.g., compared to sending each of the first audio signal and the second audio signal to, e.g., a hearing aid without having to lower the bit rate due to, e.g., channel bandwidth or other considerations or restrictions) and/or consumption of energy and processing power in a receiving device, such as a hearing aid, may be reduced (e.g., relative to a situation wherein the output audio signal is provided in the receiving device).

According to an alternative system, there is provided a system, which does not necessarily comprise a processor and/or a memory device, and wherein the system transmitter is arranged for transmitting wirelessly each of the first audio signal and the second audio signal. Further according to this alternative system, the system may furthermore comprise a hearing aid comprising a memory device and processor.

The system may further comprising:

A hearing aid, wherein the hearing aid comprises:

a. A hearing aid wireless interface for receiving the wirelessly transmitted output audio signal, and
b. An output transducer for providing the output audio signal perceivable as sound to a user.

By 'hearing aid' may be understood a device that is adapted to improve or augment the hearing capability of a user by receiving at least the transmitted output audio signal, but also the option to use or include an acoustic signal from a user's surroundings, and generating a corresponding audio signal, possibly modifying the audio signal and providing the possibly modified audio signal as an audible signal to at least one of the user's ears. The "hearing aid" may alternatively or further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing aid may be adapted to be worn in any known way. This may include i) arranging a unit of the hearing aid behind the ear with a tube leading air-borne acoustic signals into the ear canal or with a receiver/loudspeaker arranged close to or in the ear canal such as in a Behind-the-Ear type hearing aid, and/or ii) arranging the hearing aid entirely or partly in the pinna and/or in the ear canal of the user such as in an In-the-Ear type hearing aid or In-the-Canal/Completely-in-Canal type hearing aid, or iii) arranging a unit of the hearing aid attached to a fixture implanted into the skull bone such as in Bone Anchored Hearing Aid or Cochlear Implant, or iv) arranging a unit of the hearing aid as an entirely or partly implanted unit such as in Bone Anchored Hearing Aid or Cochlear Implant.

The hearing aid may be part of a "binaural hearing system" which refers to a system comprising two hearing aids where the hearing aids are adapted to cooperatively provide audible signals to both of the user's ears. The hearing aids of the binaural hearing aid system need not be of the same type. In such a binaural system, the processing of the first and second signals may be different, e.g. in the Dolby 5.1 conversion to stereo, left and right signals are different. In one case, the adjusted ratio may be the same at both ears, in order to preserve the spatial correct location of the sounds. In another case, the ratio may be different on each ear. In a further case, the ratio may be dependent on the hearing loss of that specific ear.

The system according to the present disclosure may further include auxiliary device(s) that communicates with one or more of the memory device and/or the hearing aid, the auxiliary device affecting the user defined setting and/or operation of the hearing aid and/or benefitting from the functioning of the hearing aid. A binaural hearing aid system according to the present disclosure may also be configured to communicate with such an auxiliary device. A wired or wireless communication link between on one side the memory device and/or the hearing aid and on the other side the auxiliary device is established that allows for exchanging information (e.g. control and status signals, possibly audio signals) between on one side the memory device and/or the at least one hearing aid and on the other side the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC and/or the system according to the present disclosure. The audio gateway is further adapted to select and/or combine an appropriate one of the received audio signals (or combination of signals) for transmission to the at least one hearing aid. The remote control is adapted to control functionality and operation of the memory device (such as adjusting the user defined setting) and/or the at least one hearing aid. The function of the remote control may be implemented in a SmartPhone or other electronic device, the SmartPhone/electronic device possibly running an application that controls functionality of the memory device and/or the hearing aid. The current status of the user defined setting could be displayed on a TV screen or the like and/or on a remote control. The user defined settings could as well be adjusted manually via a physical button, a switch, or a slider placed on the device.

In general, a hearing aid includes i) an input unit such as a microphone for receiving an acoustic signal from a user's surroundings and providing a corresponding input audio signal, and/or ii) a receiving unit, such as a hearing aid wireless interface, for electronically receiving an input audio signal, such as the transmitted output audio signal. The hearing aid may further include a signal processing unit for processing the input audio signal and an output unit, such as an output transducer, for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing aids, the output unit may include one or more output electrodes for providing the electric signals such as in a Cochlear Implant.

According to the present disclosure, there is presented a system wherein:

The audio streaming device,

The memory device,

The processor, and

The system transmitter are provided as a stationary unit.

Further, the stationary unit may further comprise a voice activity detection unit.

By 'unit' may be understood a separate physical entity, such as wherein every one of the audio streaming device, the memory device, the processor, and the system transmitter are comprised within a single casing, such as comprised within a single box. This may allow for one or more of easy handling, compact transport and compact storage. The unit could, alternatively, be an integrated part of a computer or television, smartphone or other device used for audio and video rendering. Further, the unit could be located at the signal provider, i.e. a distributor of a television signal, where the mixed signal is provided via. e.g., the internet. As mentioned, hearing loss compensation may be added, or more accurately applied, to the signal prior to transmitting it to the end-user.

By 'stationary' may be understood, that the unit is not adapted to be carried around by the end-user. By 'stationary' may be understood fixed in a station, such as comprising a power cord, such as a power cord for connecting the unit to the mains electricity.

According to the present disclosure, there is presented a system that may further comprise a voice recognition unit, such as a voice activity detector, comprising a voice recognition unit receiver arranged for receiving the first audio content, and a processor arranged for identifying voice activity in the first audio content.

The voice activity detector may be a detector that provides information to the processor so that the processor may adapt its processing based in that information, such as only enabling the desired mixing at the ratio when voice activity is detected. The voice activity detector may be configured to be part of the processor so that at least part of the processing may occur in the voice activity detector.

A voice recognition unit may for example be provided as described in US2009/0245539A1 which is hereby incorporated by reference in entirety. A voice recognition unit, or voice activity detection unit, may enable that an input signal with voice and background may be split into first and second audio signals where the audio content is, respectively, voice and background.

According to the present disclosure, there is presented a system wherein each of the first audio signal and the second audio signal may each be a stereo signal. The system provides a more pleasant sound experience to the user, which could include improved speech understanding, such as speech intelligibility. This may allow for a more pleasant experience for a user of the hearing aid and/or may allow improving the spatial perception.

According to the present disclosure, there is presented a system wherein

The audio streaming device receiver is further arranged for receiving a video signal, The processor is configured to detect presence of a face in the video signal, and determine time instants of voice presence and voice absence from the face, and the processor is adapted to operate signal processing algorithms based on the detection.

One principle is described in EP 3 038 383 A1 which reference is hereby incorporated by reference in entirety. This may allow for varying the ratio of a level of the first audio content and a level of the second audio content is based (in addition to the user defined setting) on voice presence and voice absence in the video signal.

More particularly, information from the video signal may also be used to improve the intelligibility. By detecting the mouth within the head present in the picture, information about when speech is present may be used to improve speech intelligibility.

According to the present disclosure, there is presented a system wherein the memory device may be controlled via the hearing aid and/or via a portable computing device, such as a SmartPhone. In the present context, control may mean transmission and/or reception of instruction or configuration data. For example, a user defined profile, such as information with user preferences, may be stored in the hearing aid and therefrom transmitted to the memory device where the user defined setting is set. This may allow reducing the work of the user in adjusting the user defined setting, as this may be done once, e.g., via the profile, and then adjusting the user defined setting in the memory device can then for example be done automatically by the hearing aid subsequently. This could also be useful in situations where the hearing aid user connects to a device which has not been connected to previously. Further, using a device for controlling the one or more user settings could allow the user to adjust settings during use, e.g. in preparation to watching a particular type of television, such as a news show or a movie.

According to the present disclosure, there is presented a system wherein the ratio of a level of the first audio content and a level of the second audio content is based on the first audio content. This may allow that the ratio depends on the first audio content, which may for example allow an improved adjustment, for example in the case of the first audio content and the second audio content being, respectively, speech and background. As an example, the ratio may be adjusted based on detection of speech in the first signal. For example, it is only necessary to decrease the background level, when speech is present and in some cases, the processor is configured to only adjusts the ratio between speech and background noise when speech activity is detected and classified as present.

According to the present disclosure, there is presented a system wherein the first audio signal may be within a finite frequency range.

Advantageously the frequency range is not limited in the processing. There may be limitations from the source, i.e. in the distributed signal.

In the system the first audio signal may be substantially a voice signal, such as wherein the first audio signal is a voice signal. Having the first audio signal being a voice signal enables that a level of the voice signal can be adjusted relative to a level of the second audio signal in the output audio signal, given that the second audio signal does not contain the same voice signal part as the first signal. One way to check if the SNR is, or at least can be, enhanced could be to calculate, e.g. for short time frames, the correlation (or other similarity measures) between the first and the second audio signal(s). If the first and second signals are highly correlated, the content, or information, is mostly the same in the two signals, and not much can be achieved by adjusting the level difference. If the correlation is low, the difference between the first and the second signals is high, and a level adjustment becomes more effective.

In the system, or method, according to the present disclosure, hearing loss compensation for a user may be applied to the output signal before it is transmitted to the user. The application of hearing loss compensation could be full or partial. The compensation could be carried out at, e.g. a provider providing video entertainment for streaming via the internet, so that when the user receives the signal, the audio part is already adapted for the hearing impaired user. This lessens the processing requirements for this compensation on the hearing impaired users equipment. As a further example SNR improvement could be applied before transmitting the output signal, and the compensation for loss of audibility could be applied in the haring instruments.

The applied hearing loss compensation may be different depending on the first and/or second audio content. E.g., the audibility of all background noise is, often, of less importance compared to the audibility, or intelligibility, of the voiced content.

According to the present disclosure, there is presented a system wherein the second audio signal is substantially a non-voice, or at least less voice, and/or background signal, such as wherein the second audio signal is a non-voice and/or background signal. Having the second audio signal being a non-voice and/or background signal enables that a level of the non-voice and/or background signal can be adjusted relative to a level of the first audio signal in the output audio signal.

According to another aspect, there is provided a method for providing and wirelessly transmitting an output audio signal, the method comprising Receiving with an audio streaming device having an audio streaming device receiver:

a. A first audio signal comprising a first audio content, b. A second audio signal comprising a second audio content, Storing in a memory device a user defined setting, Providing with a processor an output audio signal, said output audio signal comprising a combination of:

a. The first audio content, and b. The second audio content, wherein the output audio signal comprises a ratio of a level of the first audio content and a level of the second audio content, and the ratio is determined based on the user defined setting, Transmitting wirelessly with a system transmitter the output audio signal, such as transmitting via a wireless interface to a hearing aid.

The method may further comprise:

Transmitting via a wireless interface to a hearing aid,

Receiving the wirelessly transmitted output audio signal with a hearing aid wireless interface for receiving the wirelessly transmitted output audio signal, and Providing the output audio signal perceivable as sound to a user via a transducer in the hearing aid.

The method may include that the first audio signal is substantially a voice signal, such as wherein the first audio signal is a voice signal, and/or wherein the second audio signal is substantially a non-voice and/or background signal, such as wherein the second audio signal is a non-voice and/or background signal.

The features and/or technical details outlined above may be combined in any suitable ways.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure.

Figure 1:
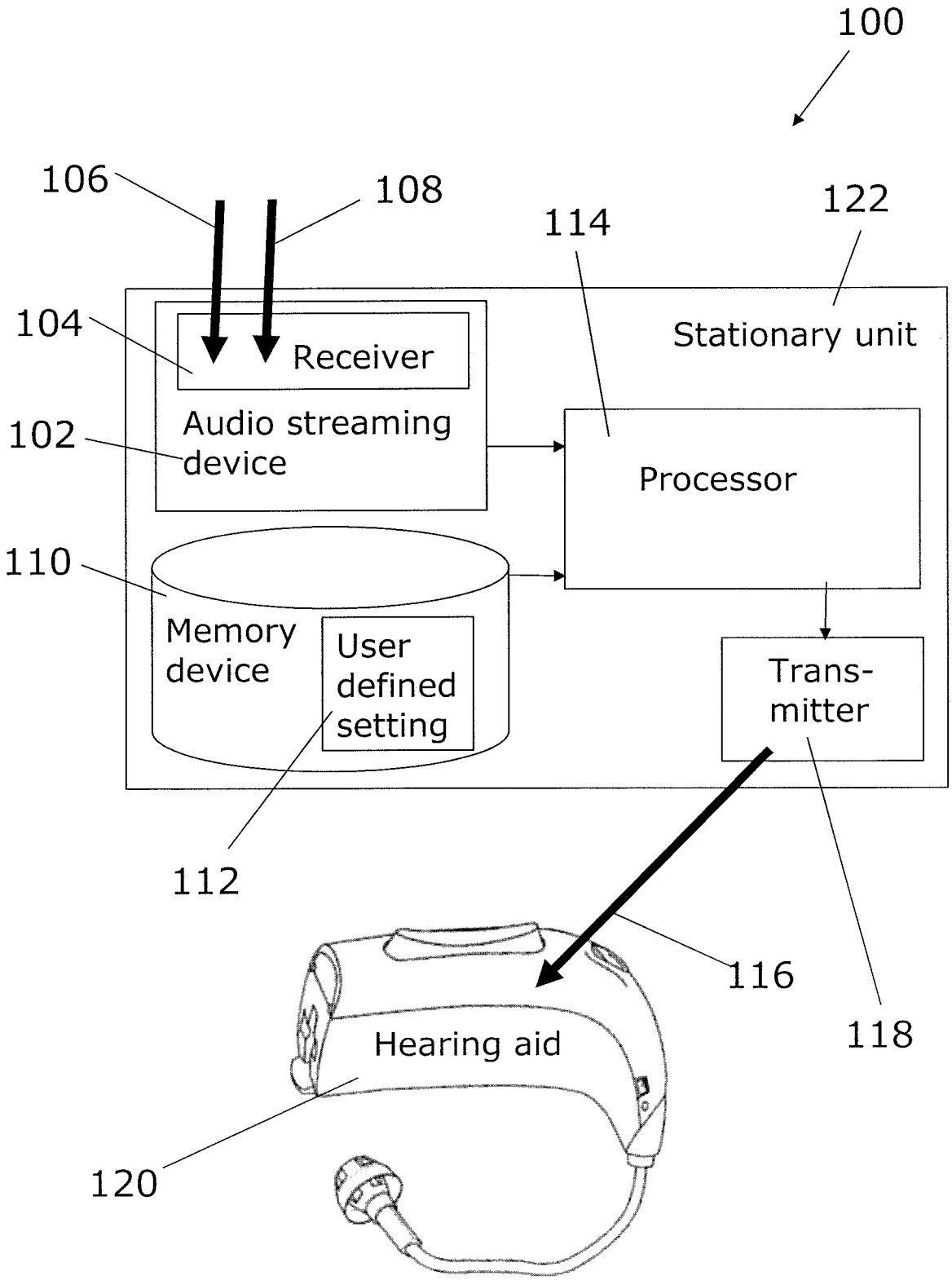
FIG. 1 schematically illustrates a system according to the disclosure.

FIG. 1 depicts a system 100 comprising:

an audio streaming device 102 having an audio streaming device receiver 104 arranged for receiving:

a. A first audio signal 106 comprising a first audio content, b. A second audio signal 108 comprising a second audio content, A memory device 110 arranged for storing a user defined setting 112, A processor 114 arranged for providing an output audio signal 116, said output audio signal comprising a combination of:

a. The first audio content, and b. The second audio content, wherein the output audio signal comprises a ratio of a level of the first audio content and a level of the second audio content, and the ratio is determined based on the user defined setting 112, A system transmitter 118 arranged for transmitting the output audio signal 116, such as wherein the output audio signal 116 is sent to a hearing aid 120.

Here the transmission is wireless, however, as the system may be built into e.g. a television, the transmission may in other cases be wired.

In FIG. 1, the system 100 further comprises a hearing aid 120, wherein the hearing aid 120 comprises a hearing aid wireless interface configured for receiving the transmitted output audio signal 116, and an output transducer for providing the output audio signal 116 perceivable as sound to a user. In some instances, an intermediate device may be used for transmitting the audio to the hearing aid 120. Here the output transducer is located in the ear piece to be inserted into the opening of the user's ear canal, in other examples the output transducer may be placed in the housing of the hearing aid 120, and the tube connecting the housing to the ear piece guides the sound via the air from the output transducer to the ear canal. In further examples, the hearing aid may be an in-the-ear hearing aid, a bone anchored hearing aid, or comprise a part implanted in the cochlea. Combinations if hearing aid types may also be part of the system, i.e. one type or style at one ear, and another type or style at the other ear.

Furthermore, in FIG. 1, the audio streaming device 102, the memory device 110, the processor 114, and the system transmitter 118 are provided as a stationary unit 122, such as encased in a single casing, such as a single case with a power cord for supplying power to each and all of the audio streaming device 102, the memory device 110, the processor 114, and the system transmitter 118 via the mains electricity. In an alternative the system may be battery driven or receive power from another device, e.g. a television or the like.

Figure 2:
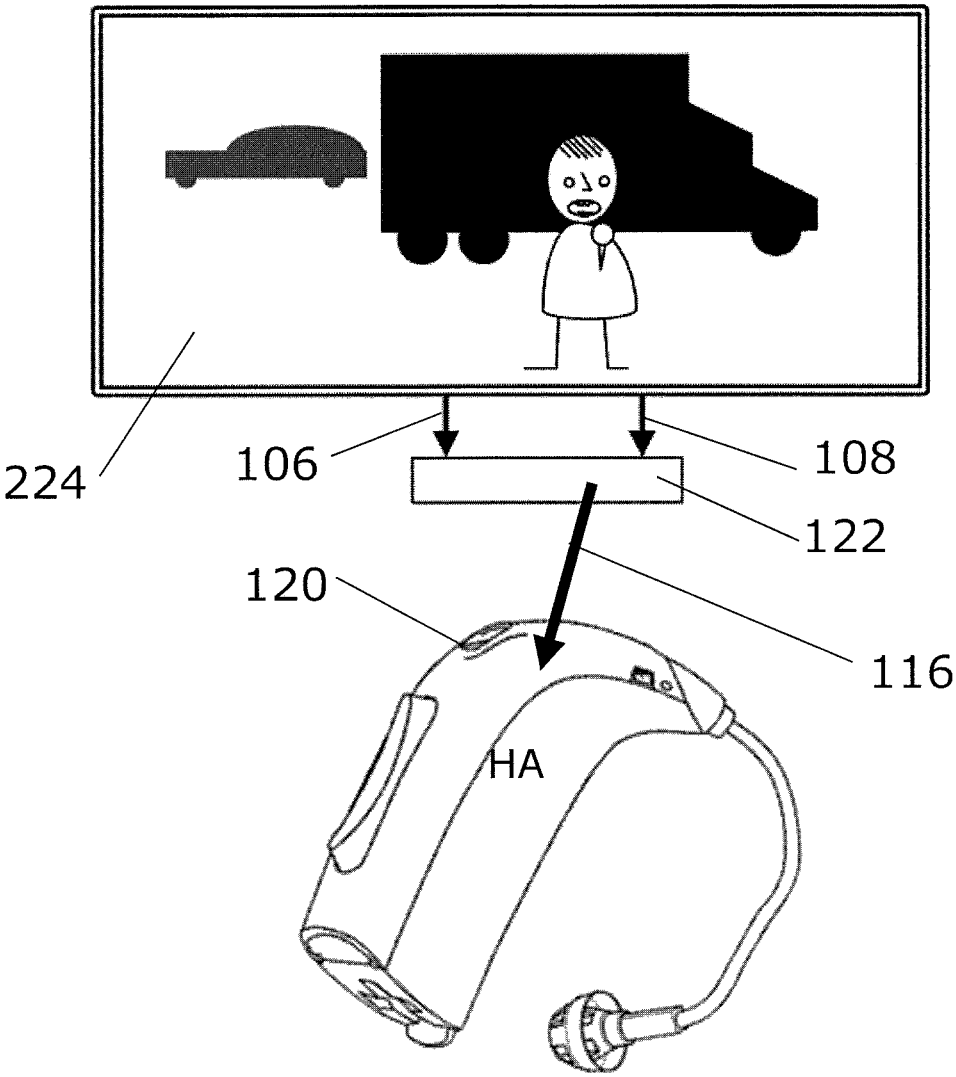
FIG. 2 schematically illustrates a specific example with a television set according to the disclosure.

FIG. 2 shows an example where a television set 224 depicts a video. Further, a first audio signal 106 and a second audio signal 108 are sent to the stationary unit 122, which then sends the output audio signal 116 to a hearing aid 120. Preferably the transmission of the output audio signal 116 to the hearing aid 120 is wireless.

In FIG. 2, the video signal comprises a person speaking and background traffic, and the corresponding first audio signal 106 and second audio signal 108 comprise, respectively, corresponding speech and background (such as the background being traffic noise). The order of processing of the audio signal may differ from the figure. In FIG. 2, the audio 106, 108 is received from the TV. In principle, the processing could be applied on the audio signal received directly from the antenna, or dvd player, etc., before the audio has passed through the television. The processed output may be presented via loudspeakers or transmitted to a hearing aid, bypassing the television speakers.

Hearing impaired people may wish to adjust the user defined setting so that a level of speech is increased relative to a level of background sound or noise. This may be carried out by setting and applying a fixed gain or by setting a fixed ratio between the two audio signals. Furthermore, such adjustment may be time or situation dependent, e.g., so as to be carried out only when speech is present. More particularly, adjusting the ratio between speech and background noise by a constant gain is not necessarily preferable. The levels of each audio channel may as well vary independently across time. By tracking the level across each channel relative to the level of the channel mainly containing speech, one can ensure that the ratio between speech and background remains constant. E.g. the speech to background ratio may be set to never be below 10 dB. The ratio could e.g. measured as an average over a certain amount of time. Levels may be measured e.g. using first order low pass filters with a certain time constant, or by using a moving average in terms of an FIR filter. It may only be necessary to decrease the background noise level when speech is present. It is encompassed to provide a more intelligent volume control, which only adjust the ratio between speech and background noise when speech is present. Otherwise, the background noise may still be of interest for the hearing impaired listener, often background sounds provide some ambiance to the video.

Figure 3:
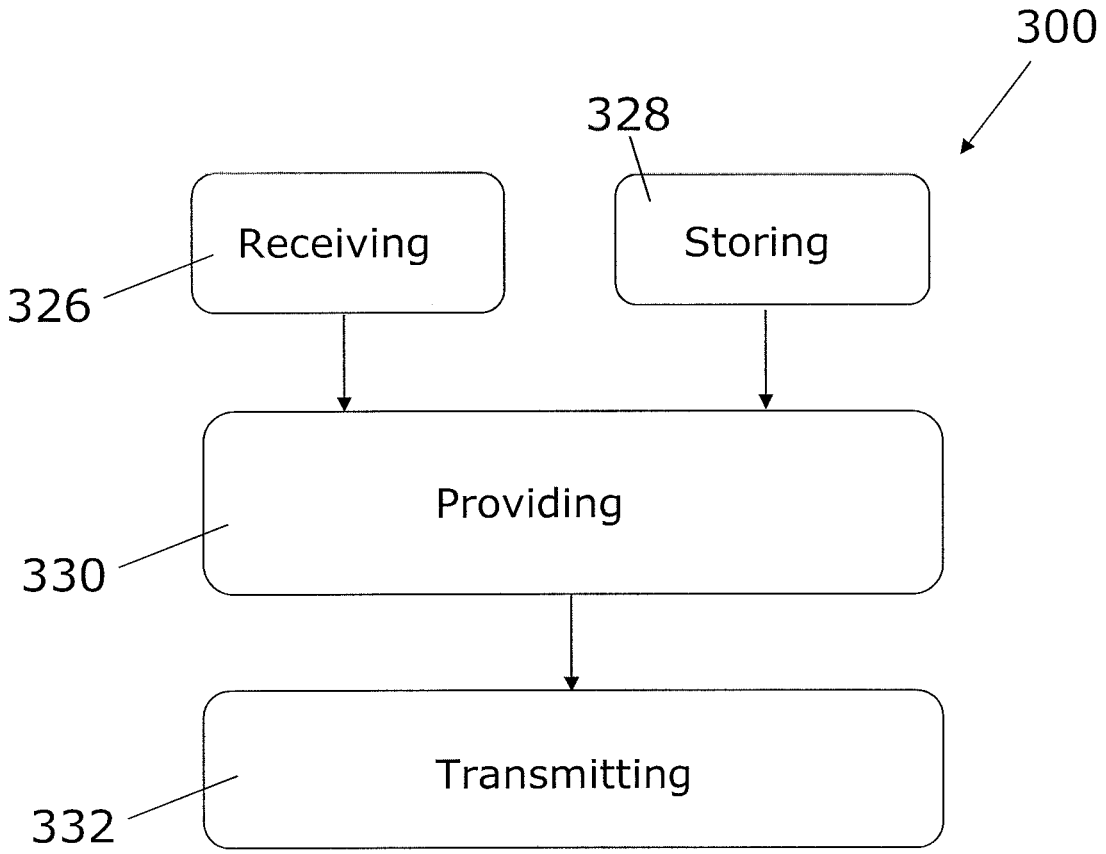
FIG. 3 depicts steps of a method according to the disclosure.

FIG. 3 depicts a method 300 for providing and transmitting an output audio signal, the method comprising Receiving 326 with an audio streaming device 102 having an audio streaming device receiver 104 a source signal comprising at least audio, and the audio streaming device further arranged for splitting the audio into at least a first audio signal and a second audio signal wherein:

a. the first audio signal 106 comprises a first audio content, b. the second audio signal 108 comprises a second audio content, Storing 328 in a memory device 110 a user defined setting 112, Providing 330 with a processor 114 an output audio signal 116, said output audio signal 116 comprising a combination of:

a. The first audio content, and b. The second audio content, wherein the output audio signal 116 comprises a ratio of a level of the first audio content and a level of the second audio content, and the ratio is determined based on the user defined setting 112, Transmitting 332 with a system transmitter 118 the output audio signal 116, such as transmitting via a wireless interface to a hearing aid 120.

Here the source signal could be a video signal comprising an image part and an audio part, as outlined above. As described elsewhere, the audio could be single channel or multi channel, such as stereo or surround, such as 5.1 or 7.1.

A system may be configured to perform the steps of the method, as an example the system of FIGS. 1 and 2 may be configured to perform the steps. The system may include devices and components configured to carry out the method as described herein.

Figure 4:
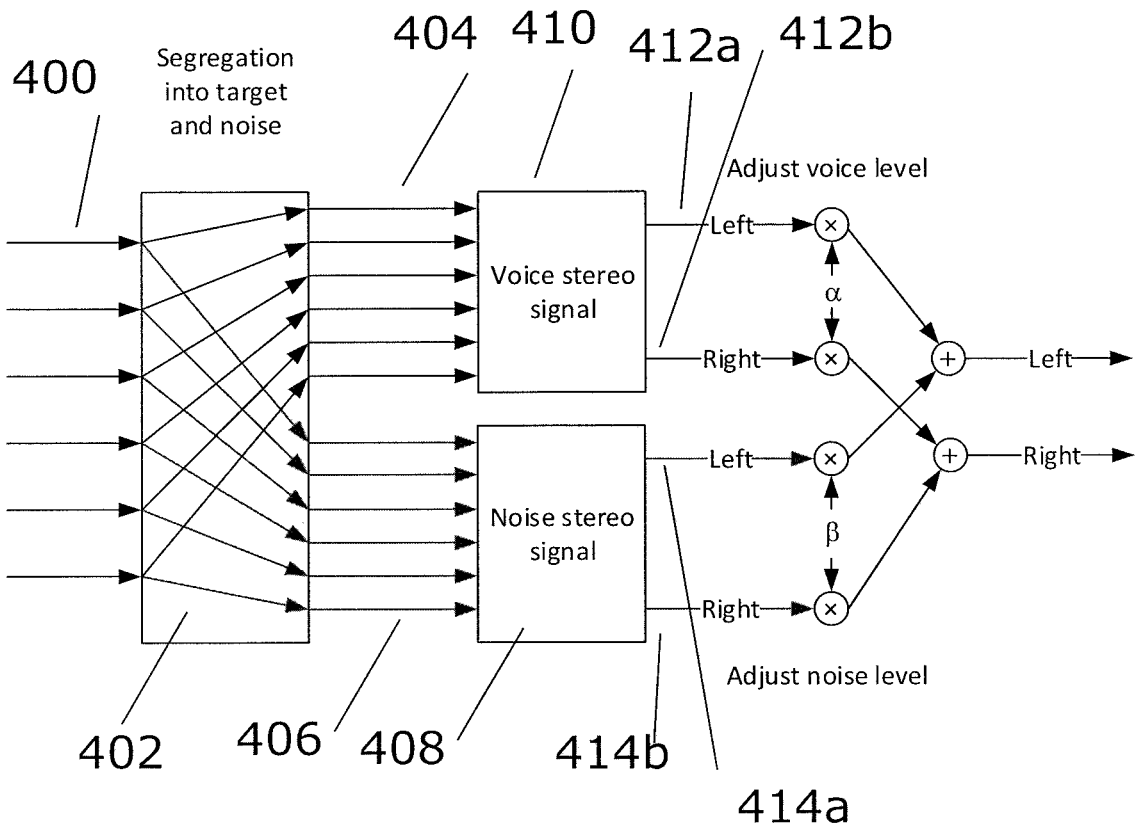
FIG. 4 schematically illustrates part of an example of signal processing according to the present disclosure.

FIG. 4 schematically illustrate a system where one stream 400 is received and split into two streams. The received stream 400 is a multichannel stream, here illustrated as a 5.1 stream. Each resulting split stream 402 and 404 comprises 5.1 audio, that is, 5 surround channels and a bass channel. In the component 402, the received stream 400 is segregated into a speech, i.e. voice signal 404, and a non-speech 406, i.e. noise or background signal, part.

At 408 and 410 in addition to being segregated, each of the two signals 404 and 406 are converted to stereo signals 412*a* and 412*b*, and 414*a* and 414*b* respectively. This means that there now is a substantially voice only signal having a left and a right channel, and a substantially non-voice signal having a left and a right channel, in all four signals.

The level of the left 412*a* and right 412*b* voice channel, respective level of left 414*a* and right 414*b* non-voice channel, are each adjusted with scale alpha 418 and beta 420. The scales alpha and beta together constitute an example of the ratio described above. The scaling may be based on an over-all evaluation of the level, or may be made for one or more individual frequency bands. As an example, the voice level may be increased relative to the none-voice level in the frequency range where speech is present, and not changed for the region or regions where no speech is present. Further, the ratio may be time and/or event dependent. The adjusted signals are then mixed, i.e. adjusted left voice signal 412*a* is mixed with adjusted left noise or none-voice signal 414*a* for left output 416 and adjusted right voice signal 412*b* is mixed with adjusted right noise or none-voice signal 414*b* to right output signal 418 to be presented to the user, either via one or two hearing aids either directly or through an intermediate device, or via another sound reproducing unit, e.g. the television or other speaker device.

In addition to the ratio mixing, other types of processing may be included in the system and/or method according to the present specification, this could be hearing loss compensation, noise reduction or the like. As mentioned, the method may be performed for one, or a number of, frequency bands. This could include multiple frequency bands in the frequency region where voice is usually present.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A system comprising:

an audio streaming device having an audio streaming device receiver arranged for receiving a source signal comprising at least an audio signal part, and the audio streaming device further arranged for splitting the audio signal part of the source signal into at least a first audio signal and a second audio signal wherein:

the first audio signal comprises a first audio content, the second audio signal comprises a second audio content, a memory device arranged for storing a user defined setting, a processor arranged for providing an output audio signal, said output audio signal being based on a combination of:

the first audio content, and the second audio content, a voice activity detector configured to detect voice in the first audio content, and subsequent to detection of voice activity the processor being configured to combine the first audio content and the second audio content based on a ratio of an audio level of the first audio content and an audio level of the second audio content, and the ratio is determined based on the user defined setting, and a system transmitter arranged for transmitting the output audio signal.

2. The system according to claim 1, wherein the audio streaming device is further configured to receive meta data in the source signal, and the audio streaming device is further configured to process the first and/or second audio content based on the meta data.

3. The system according to claim 2, wherein the meta data comprises one or more of: subtitles, information from a program overview, unmixing parameters, noise content in the first and/or second audio content.

4. The system according to claim 1, wherein the source signal is a multichannel signal comprising at least 2 separate audio streams.

5. The system according to claim 4, wherein each of the at least 2 separate audio stream comprises a combination of the first and the second audio content.

6. The system according to claim 1, wherein the system further comprises:

a hearing aid, wherein the hearing aid comprises:

a hearing aid interface for receiving the transmitted output audio signal, and an output transducer for providing the output audio signal perceivable as sound to a user.

7. The system according to claim 1, wherein the audio streaming device, the memory device, the processor, and the system transmitter are provided as a stationary unit.

8. The system according to claim 1, wherein the voice activity detector comprises a receiver arranged for receiving said first audio content, and a processor arranged for identifying voice activity in the first audio content.

9. The system according to claim 1, wherein each of the first audio signal and the second audio signal is a stereo signal or a multichannel signal, optionally the output audio signal is a stereo signal and/or a multichannel signal.

10. The system according to claim 1, wherein the audio streaming device receiver is further arranged for receiving a video signal, the processor is configured to detect presence of a face in the video signal, and determine time instants of voice presence and voice absence from the face, and the processor is adapted to operate signal processing algorithms based on the detection.

11. The system according to claim 6, wherein the memory device is controlled via the hearing aid and/or via a portable computing device and/or a SmartPhone.

12. The system according to claim 1, wherein the ratio of a level of the first audio content and a level of the second audio content is based on the first audio content.

13. The system according to claim 1, wherein the ratio is determined based on the user's hearing loss.

14. The system according to claim 1, wherein the first audio signal is substantially a voice signal.

15. The system according to claim 1, wherein the second audio signal is substantially a non-voice and/or background signal.

16. A method for providing and transmitting an output audio signal, the method comprising receiving with an audio streaming device having an audio streaming device receiver a source signal comprising at least an audio signal part, and the audio streaming device further arranged for splitting the audio signal part into at least a first audio signal and a second audio signal wherein:

the first audio signal comprises a first audio content, and the second audio signal comprises a second audio content, storing in a memory device a user defined setting, providing with a processor an output audio signal, said output audio signal comprising a combination of:

the first audio content, and the second audio content, detecting, via a voice activity detector, voice activity in the first audio content, and subsequent to detection of voice activity combining the first audio content and the second audio content based on a ratio of an audio level of the first audio content and an audio level of the second audio content, and the ratio is determined based on the user defined setting, transmitting with a system transmitter the output audio signal.

17. The method according to claim 16, wherein the method further comprises:

transmitting via a wireless interface to a hearing aid, receiving the wirelessly transmitted output audio signal with a hearing aid wireless interface for receiving the wirelessly transmitted output audio signal, and providing the output audio signal perceivable as sound to a user via a transducer in the hearing aid.

18. The method according to claim 16, wherein the first audio signal is substantially a voice signal, and/or wherein the second audio signal is substantially a non-voice and/or background signal.

19. The method according to claim 16, wherein hearing loss compensation for a user is applied to the output signal before it is transmitted to the user.

* * * * *